US011756490B2

(12) United States Patent
Watanabe

(10) Patent No.: US 11,756,490 B2
(45) Date of Patent: Sep. 12, 2023

(54) DISPLAY DEVICE AND DISPLAY DRIVER

(71) Applicant: LAPIS Semiconductor Co., Ltd., Yokohama (JP)

(72) Inventor: Yukinobu Watanabe, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 0 days.

(21) Appl. No.: 17/850,947

(22) Filed: Jun. 27, 2022

(65) Prior Publication Data

US 2022/0328014 A1 Oct. 13, 2022

Related U.S. Application Data

(63) Continuation of application No. 16/816,300, filed on Mar. 12, 2020, now Pat. No. 11,393,409.

(30) Foreign Application Priority Data

Mar. 14, 2019 (JP) ..... 2019-046651

(51) Int. Cl.
*G09G 3/3291* (2016.01)
*G09G 3/36* (2006.01)
(Continued)

(52) U.S. Cl.
CPC ..... *G09G 3/3291* (2013.01); *G09G 3/2092* (2013.01); *G09G 3/3208* (2013.01);
(Continued)

(58) Field of Classification Search
CPC .. G09G 3/3291; G09G 3/2092; G09G 3/3208; G09G 3/3225; G09G 3/3275;
(Continued)

(56) References Cited

U.S. PATENT DOCUMENTS

2012/0166896 A1* 6/2012 Oh ..... G09G 5/18 714/704
2017/0193892 A1* 7/2017 Ha ..... G09G 3/2022
2020/0202818 A1* 6/2020 Kuroiwa ..... G09G 5/393

FOREIGN PATENT DOCUMENTS

JP 2006098923 4/2006
JP 2009109955 5/2009
(Continued)

OTHER PUBLICATIONS

"Notice of Reasons for Refusal of Japan Counterpart Application", dated Oct. 4, 2022, with English translation thereof, p. 1-p. 6.

*Primary Examiner* — Patrick N Edouard
*Assistant Examiner* — Joseph P Fox
(74) *Attorney, Agent, or Firm* — JCIPRNET

(57) ABSTRACT

A display device which can suppress erroneous display of a display panel is provided. A source driver receives a serial data signal in which a preamble and video data of the display panel are alternately continuous via an interface from a display controller. The source driver controls timing of supply of a gate signal from a gate driver based on the video data included in the serial data signal, and supplies a gradation voltage signal which corresponds to the video data to a plurality of data lines of the display panel. The source driver has a detection portion which detects that the interface is in an unstable state, and a gate reset signal output portion which outputs a gate reset signal for stopping an operation of the gate driver when the unstable state of the interface is detected at the time of the supply of the video data.

4 Claims, 11 Drawing Sheets

(51) Int. Cl.

| | |
|---|---|
| ***G09G 3/20*** | (2006.01) |
| ***G09G 3/3208*** | (2016.01) |
| ***G09G 3/3225*** | (2016.01) |
| ***G09G 3/3275*** | (2016.01) |

(52) U.S. Cl.
CPC ..... *G09G 3/3225* (2013.01); *G09G 3/3275* (2013.01); *G09G 3/3648* (2013.01); *G09G 3/3688* (2013.01); *G09G 2310/062* (2013.01); *G09G 2310/08* (2013.01)

(58) Field of Classification Search
CPC ..... G09G 3/3648; G09G 3/3688; G09G 2310/062; G09G 2310/08
See application file for complete search history.

(56) References Cited

FOREIGN PATENT DOCUMENTS

| | | |
|---|---|---|
| JP | 2009163239 | 7/2009 |
| JP | 2010204667 | 9/2010 |
| JP | 2018109751 | 7/2018 |
| JP | 2018180414 | 11/2018 |

* cited by examiner

DISPLAY DEVICE AND DISPLAY DRIVER

CROSS-REFERENCE TO RELATED APPLICATION

This application is a continuation application of the U.S. patent application Ser. No. 16/816,300, filed on Mar. 12, 2020, which claims the priority benefit of Japan Application No. 2019-046651, filed on Mar. 14, 2019. The entirety of each of the above-mentioned patent applications is hereby incorporated by reference herein and made a part of this specification.

BACKGROUND OF THE DISCLOSURE

Technical Field

The disclosure relates to a display device and a display driver.

Related Art

An active matrix driving method is employed as a driving method for a display device such as a liquid crystal display device, an organic EL (Electro Luminescence) or the like. In a display device using the active matrix driving method, a display panel includes a semiconductor substrate in which pixel portions and pixel switches are arranged in a matrix shape. On/off of the pixel switches is controlled by gate pulses, a gradation voltage signal corresponding to a video data signal is supplied to the pixel portions to control luminance of each pixel portion when the pixel switches are turned on, and thereby display is performed. A drive circuit of the display device includes, for example, a gate control circuit which controls the gate pulses, a driver IC which supplies a data signal to a data line, and a timing controller which controls operation timing of the gate control circuit and the driver IC.

As the aforementioned display device, a display device is proposed which has a driver IC executing clock training for stably fixing the phase and the frequency of an internal clock (for example, patent literature 1). The timing controller is connected to the driver IC via a peer-to-peer (hereinafter referred to as P2P) interface, and supplies a serial data including a preamble signal and video data to the driver IC by, for example, a differential signal method such as mini-LVDS (mini-Low Voltage Differential Signaling) or the like. The driver IC performs the clock training by using the preamble signal which is a data pattern for clock training.

LITERATURE OF RELATED ART

Patent Literature

[Patent literature 1] Japanese Patent Laid-Open No. 2015-79236

When supplying data to the driver IC, the timing controller supplies, to the driver IC, a data switching signal which can determine whether the data is the data pattern for clock training or display data in the driver IC. For example, the timing controller supplies an "L"-level data switching signal to the driver IC and supplies the data pattern for clock training to the driver IC. After that, when the P2P interface between the timing controller and the driver IC is switched from an unlocked state to a locked state (a stable state), the timing controller switches the switching signal to an "H" level and supplies the display data to the driver IC. Accordingly, the driver IC supplies a gate control signal to the gate control circuit, controls the gate control circuit to apply the gate pulses to display pulses, and supplies the data signal to the data line. Thereby, an image is displayed on the display panel.

However, in a normal display period when the image is displayed on the display panel, the P2P interface between the timing controller and the driver IC may come into an unlocked state due to noise caused by ESD (Electro Static Discharge) or the like. When the P2P interface comes into the unlocked state, the data cannot be normally taken into the driver IC, and thus the driver IC cannot output a gate control signal and a data signal with normal values. As a result, there is a problem that a display different from an expected display is shown on the display panel.

The disclosure provides a display device which can suppress erroneous display of a display panel caused by an influence of noise or the like.

SUMMARY

The display device according to the disclosure includes: a display panel which has a plurality of data lines and a plurality of scanning lines, and pixel switches and pixel portions arranged at respective intersection portions of the plurality of data lines and the plurality of scanning lines; a gate driver which supplies a gate signal of turning on the pixel switches to the plurality of scanning lines; a display controller which outputs a serial data signal in which a preamble and video data displayed on the display panel are alternately continuous; and a source driver which is connected to the display controller via an interface, detects a stable state or an unstable state of the interface based on the serial data signal transmitted from the display controller via the interface, and outputs, when an unstable state of the interface is detected at the time of the supply of the video data, a gate reset signal for stopping the supply of the gate signal from the gate driver.

In addition, the display driver according to the disclosure is connected to a display panel and a gate driver, wherein the display panel has a plurality of data lines and a plurality of scanning lines and pixel switches and pixel portions arranged at respective intersection portions of the plurality of data lines and the plurality of scanning lines, the gate driver supplies a gate signal of turning on the pixel switches to the plurality of scanning lines, and the display driver supplies a gradation voltage signal which corresponds to video data to the plurality of data lines; the display driver is connected to a display controller via an interface and receives supply of a serial data signal in which a preamble and the video data are alternately continuous via the interface from the display controller, and the display driver has: a detection portion which detects that the interface is in a stable state and an unstable state based on the serial data signal transmitted via the interface, and a gate reset signal output portion which outputs a gate reset signal for stopping an operation of the gate driver when the unstable state of the interface is detected by the detection portion at the time of the supply of the video data.

DESCRIPTION OF THE EMBODIMENTS

According to the display device of the disclosure, it is possible to suppress erroneous display generated on the display panel when the interface between the timing controller and the driver ICs comes into the unlocked state due to noise or the like.

Preferred examples of the disclosure are described below in detail. Moreover, in the following description of each example and accompanying drawings, substantially identical or equivalent parts are denoted by the same reference signs.

Embodiment 1

Figure 1:
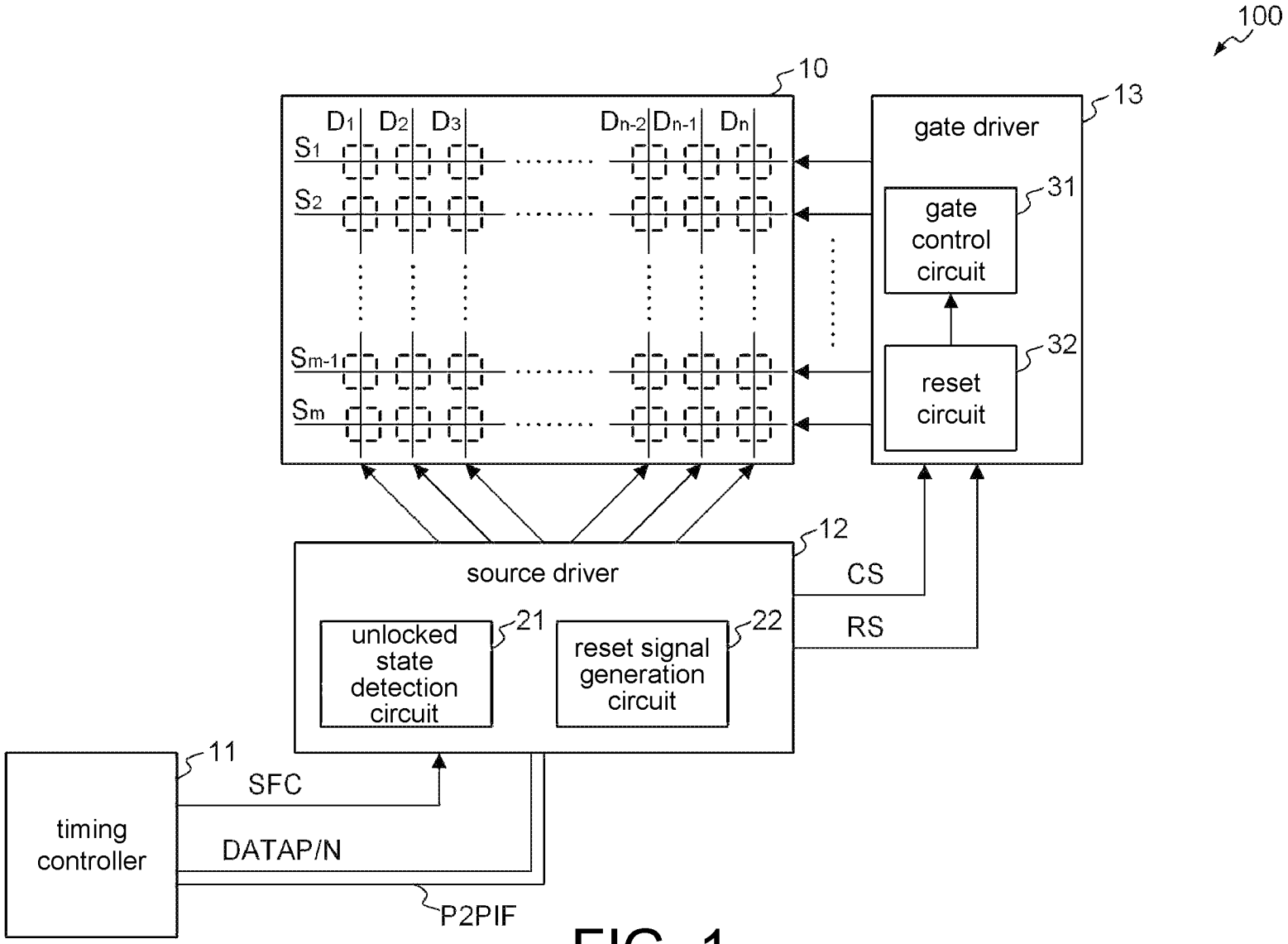
FIG. 1 is a block diagram showing a configuration of a display device according to Embodiment 1.

FIG. 1 is a block diagram showing a configuration of a display device 100 according to the embodiment. The display device 100 includes a display panel 10, a timing controller 11, a source driver 12, and a gate driver 13.

The display panel 10 is, for example, an image display device including a liquid crystal display panel, an organic EL (electro luminescence) panel or the like. In the display panel 10, m horizontal scanning lines S1 to Sm (m is a natural number of 2 or more) which extend in a horizontal direction of a two dimensional screen, and n source lines D1 to Dn (n is a natural number of 2 or more) which extend in a vertical direction of the two dimensional screen are formed. Display cells serving as pixels are formed in regions at respective intersection portions of the horizontal scanning lines and the source lines, in other words, in regions surrounded by broken lines in FIG. 1.

The timing controller 11 is a display controller (a so-called T-CON) which controls display timing of an image on the display panel 10 by supplying a data line signal DATAP/N to the source driver 12. The timing controller 11 is connected to the source driver 12 via a peer-to-peer interface (hereinafter referred to as P2PIF), and transmits the data line signal DATAP/N by, for example, a differential signal method such as mini-LVDS or the like.

The data line signal DATAP/N is a serial data signal in which a preamble signal and display video data for one frame (hereinafter referred to as display data) are alternately continuous. The preamble signal includes training pattern data for clock training. The training pattern data is data used for clock training executed in the source driver 12 in order to stably fix the phase and the frequency of an internal clock. In one-frame display period, the timing controller first supplies the preamble signal including the training pattern data to the source driver 12, and then supplies the display data for one frame to the source driver 12.

The P2PIF between the timing controller 11 and the source driver 12 is switched from an unlocked state (an unstable state) to a locked state (a stable state) because of the transmission of the training pattern data. Thus, the transmission of the display data in the display period after a clock training period is performed via the locked P2PIF in a normal case (that is, a case when there is no influence of noise or the like).

In addition, the timing controller 11 supplies the source driver 12 with a data switching signal SFC which can determine whether the data line signal DATAP/N is training pattern data or display data at a side of the source driver 12. For example, the timing controller 11 supplies an "L"-level data switching signal SFC to the source driver 12 when supplying the training pattern data as the data line signal DATAP/N. In addition, the timing controller 11 supplies an "H"-level data switching signal SFC to the source driver 12 when supplying the display data as the data line signal DATAP/N.

The source driver 12 is a display driver which generates n image drive voltages for each horizontal scanning line based on the display data supplied from the timing controller 11 via the P2PIF and applies the n image drive voltages to the source lines D1 to Dn of the display panel 10. In this embodiment, the source driver 12 includes one IC (Integrated Circuit). In addition, the source driver 12 supplies the gate driver 13 with a gate control signal CS for controlling an operation of the gate driver 13.

In addition, the source driver 12 includes an unlocked state detection circuit 21 and a reset signal generation circuit 22. The unlocked state detection circuit 21 detects that the P2PIF is in an unlocked state based on the data transmitted via the P2PIF. For example, the unlocked state detection circuit 21 detects the unlocked state of the P2PIF in a manner that data including an error code is transmitted as the data line signal DATAP/N from the timing controller 11, and error detection is performed based on the data.

The reset signal generation circuit 22 generates a gate reset signal RS for stopping the operation of the gate driver 13. The reset signal generation circuit 22 generates, for example, an "H"-level gate reset signal RS when the unlocked state of the P2PIF is detected and an "L"-level gate reset signal RS when the unlocked state is not detected. Moreover, the source driver 12 of the embodiment is directly connected to the gate driver 13 through signal lines, and the gate reset signal RS generated by the reset signal generation circuit 22 is supplied to the gate driver 13.

The gate driver 13 includes a gate control circuit 31 and a reset circuit 32. The gate control circuit 31 generates gate pulses based on the gate control signal CS supplied from the source driver 12, and sequentially and alternatively applies the gate pulses to each of the scanning lines S1 to Sm of the display panel 10. According to the gate reset signal RS supplied from the source driver 12, the reset circuit 32 stops an application operation of the gate pulses performed by the gate control circuit 31, and resets the operation state of the gate control circuit 31.

Figure 2:
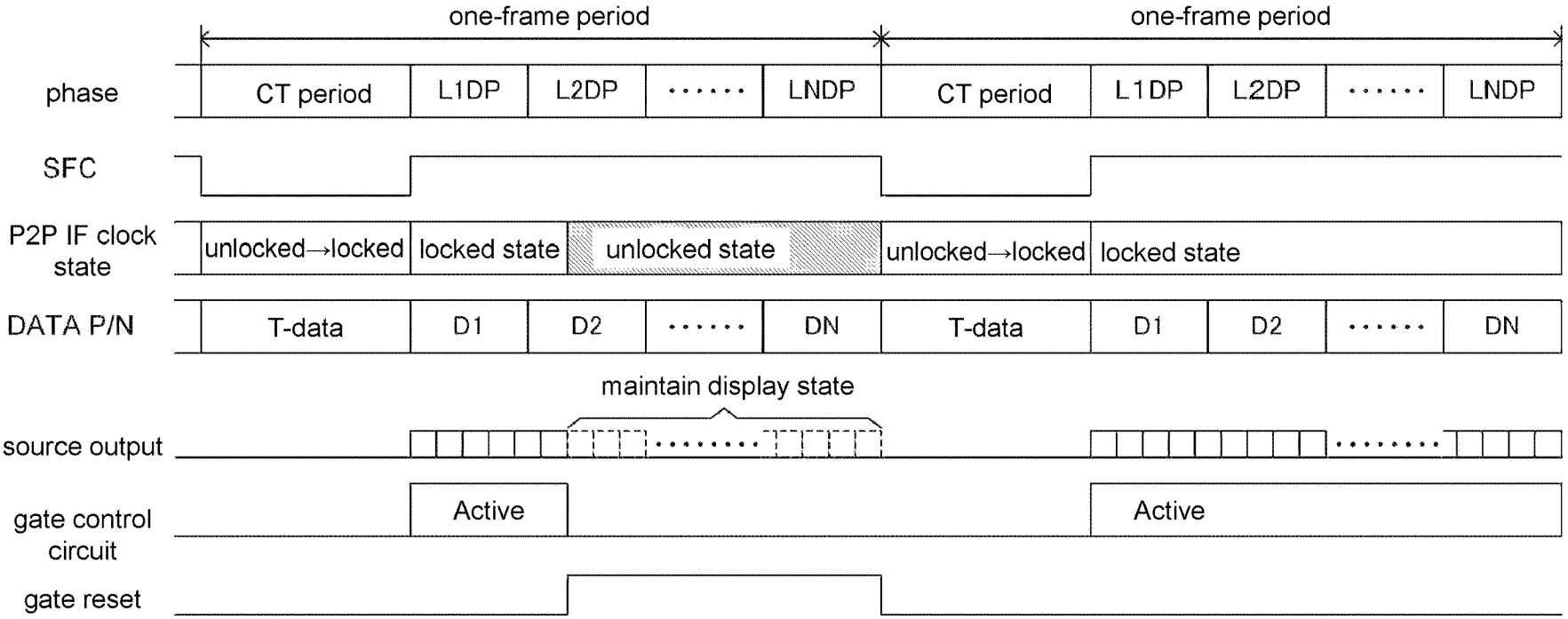
FIG. 2 is a time chart showing states and output signals of respective portions of the display device according to Embodiment 1.

Next, the operation of the display device 100 of the embodiment is described with reference to a time chart in FIG. 2. Moreover, here, the operation when the unlocked state occurs in the P2PIF between the timing controller 11 and the source driver 12 during the display periods is described.

First, in the clock training period (shown as a CT period in FIG. 2), the timing controller 11 supplies the "L"-level data switching signal SFC to the source driver 12. In addition, in this period, the timing controller 11 supplies the training pattern data (shown as T-data in FIG. 2) to the source driver 12. The P2PIF which is the interface between the timing controller 11 and the source driver 12 is switched from the unlocked state to the locked state.

Next, in the display periods (indicated as L1DP, L2DP . . . LNDP in FIG. 2) in which the normal data display is performed, the timing controller 11 supplies the "H" level data switching signal SFC to the source driver 12. Then, the timing controller 11 supplies the display data to the source driver 12 as the data line signal DATAP/N. For example, the timing controller 11 first supplies, in the display period L1DP, display data D1 for displaying an image on display cells of the first line (that is, display cells along the horizontal scanning line S1) to the source driver 12.

The source driver 12 generates the gate control signal CS based on the display data D1, and supplies the gate control signal CS to the gate driver 13. The gate control circuit 31 of the gate driver 13 becomes active according to the supply of the gate control signal CS, and applies the gate pulse to the first horizontal scanning line S1. In addition, the source driver 12 applies n image drive voltages for one horizontal scanning line to the source lines D1 to Dn of the display panel 10. Accordingly, display for one line on the display panel 10 is performed.

Next, in the display period L2DP, the timing controller 11 supplies display data D2 for displaying an image on display cells of the second line (that is, display cells along the horizontal scanning line S2) as the data line signal DATAP/N to the source driver 12. At this time, if the P2PIF which is the interface between the timing controller 11 and the source driver 12 comes in the unlocked state due to the influence of noise of ESD or the like, an abnormality occurs in the transmission of the data line signal DATAP/N.

The unlocked state detection circuit 21 of the source driver 12 detects the unlocked state of the P2PIF based on the data line signal DATAP/N supplied from the timing controller 11. The reset signal generation circuit 22 supplies the "H"-level gate reset signal RS to the gate driver 13 according to the detection of the unlocked state performed by the unlocked state detection circuit 21.

The reset circuit 32 of the gate driver 13 stops the operation of the gate control circuit 31 according to the supply of the "H"-level gate reset signal RS, and resets the operation state. Accordingly, the application of the gate pulses by the gate control circuit 31 is stopped, and the display panel 10 maintains the previous display state.

The reset signal generation circuit 22 of the source driver 12 continues to supply the "H"-level gate reset signal RS until the end of the one-frame period (that is, until the display period LNDP). Accordingly, the reset circuit 32 of the gate driver 13 stops the operation of the gate control circuit 31, and thus the previous display state is maintained on the display panel 10 until the end of the one-frame period.

In the next frame period, the source driver 12 returns the signal level of the gate reset signal RS to "L". Since the start of the one-frame period is the clock training period, the timing controller 11 supplies the "L"-level data switching signal SFC and the training pattern data to the source driver 12. The P2PIF between the timing controller 11 and the source driver 12 is switched from the unlocked state to the locked state.

In a subsequent display period, the timing controller 11 sequentially supplies display data D1, D2 . . . DN to the source driver 12 as the data line signal DATAP/N. The source driver 12 supplies the gate control signal CS to the gate driver 13. The gate control circuit 31 of the gate driver 13 becomes active, and applies the gate pulses to each of the horizontal scanning lines S1 to Sm. The source driver 12 applies the image drive voltages to the source lines D1 to Dn of the display panel 10. When the unlocked state caused by ESD noise or the like does not occur in the P2PIF, normal image display is performed from the start line in order in the display panel 10.

As described above, in the display device 100 of the embodiment, when the source driver 12 detects that the P2PIF comes into the unlocked state during the display periods, the gate reset signal RS is supplied to the gate driver 13, and the operation of the gate control circuit 31 is stopped. Accordingly, the display panel 10 maintains the previous display state.

According to the display device 100 of the embodiment, the erroneous display on the display panel 10 due to the P2PIF between the timing controller 11 and the source driver 12 coming into the unlocked state during the image display periods can be suppressed. This will be described with reference to FIG. 3-FIG. 5.

Figure 3:
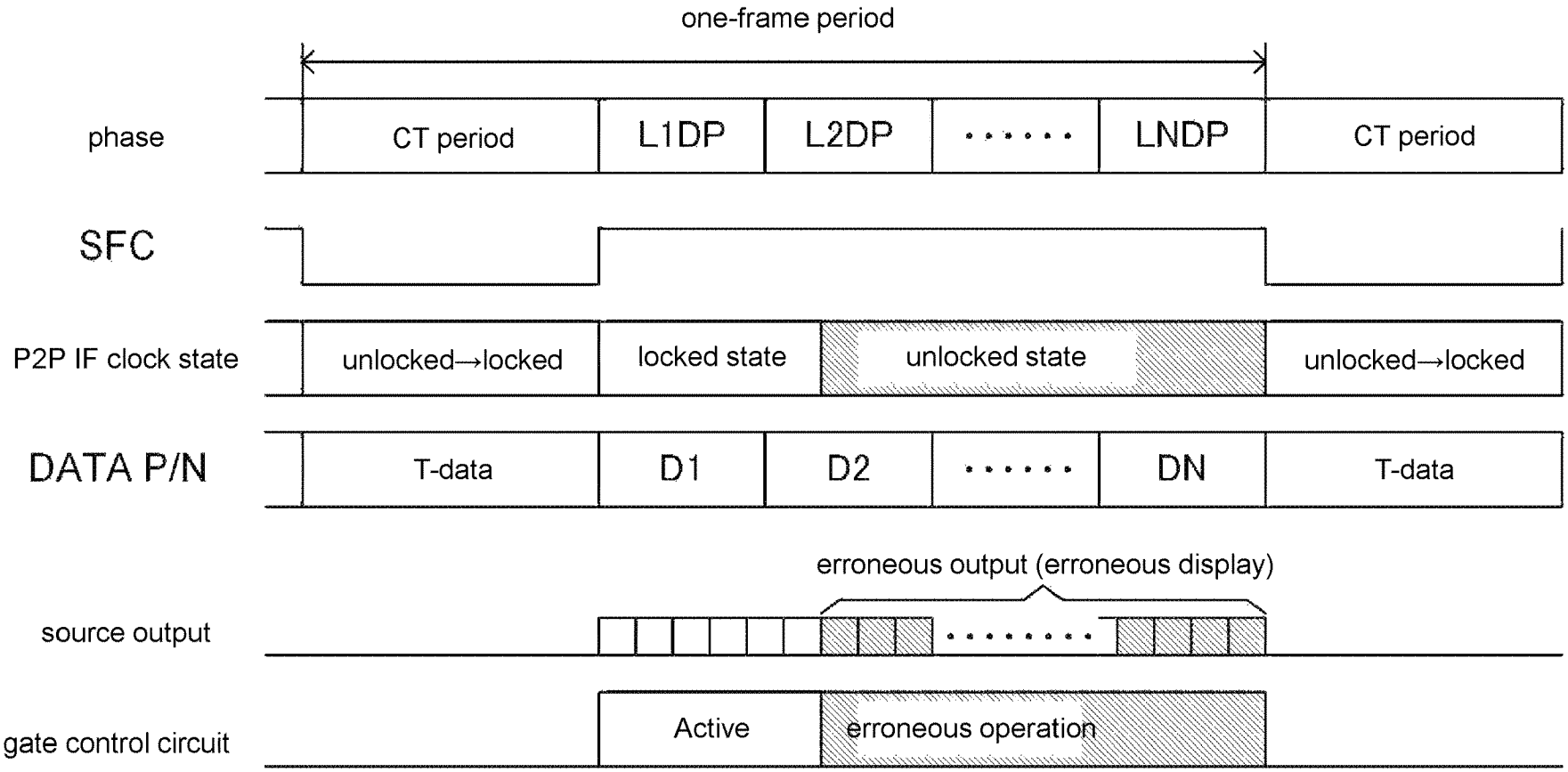
FIG. 3 is a time chart showing states and output signals of respective portions of a display device according to Comparison example 1.

FIG. 3 is a time chart showing an operation of a display device of Comparison example 1 in which, unlike the present embodiment, the source driver 12 does not generate and supply a gate reset signal RS. The operations in the clock training period and the display period L1DP are the same as the operations of the display device 100 of the present embodiment.

If the noise caused by ESD occurs in the display period L2DP and the P2PIF comes into the unlocked state, display data output from the timing controller 11 is not normally taken into the source driver 12. Thus, the source driver 12 cannot output the gate control signal CS and the pixel drive voltage (that is, source output) with normal values.

Figure 4:
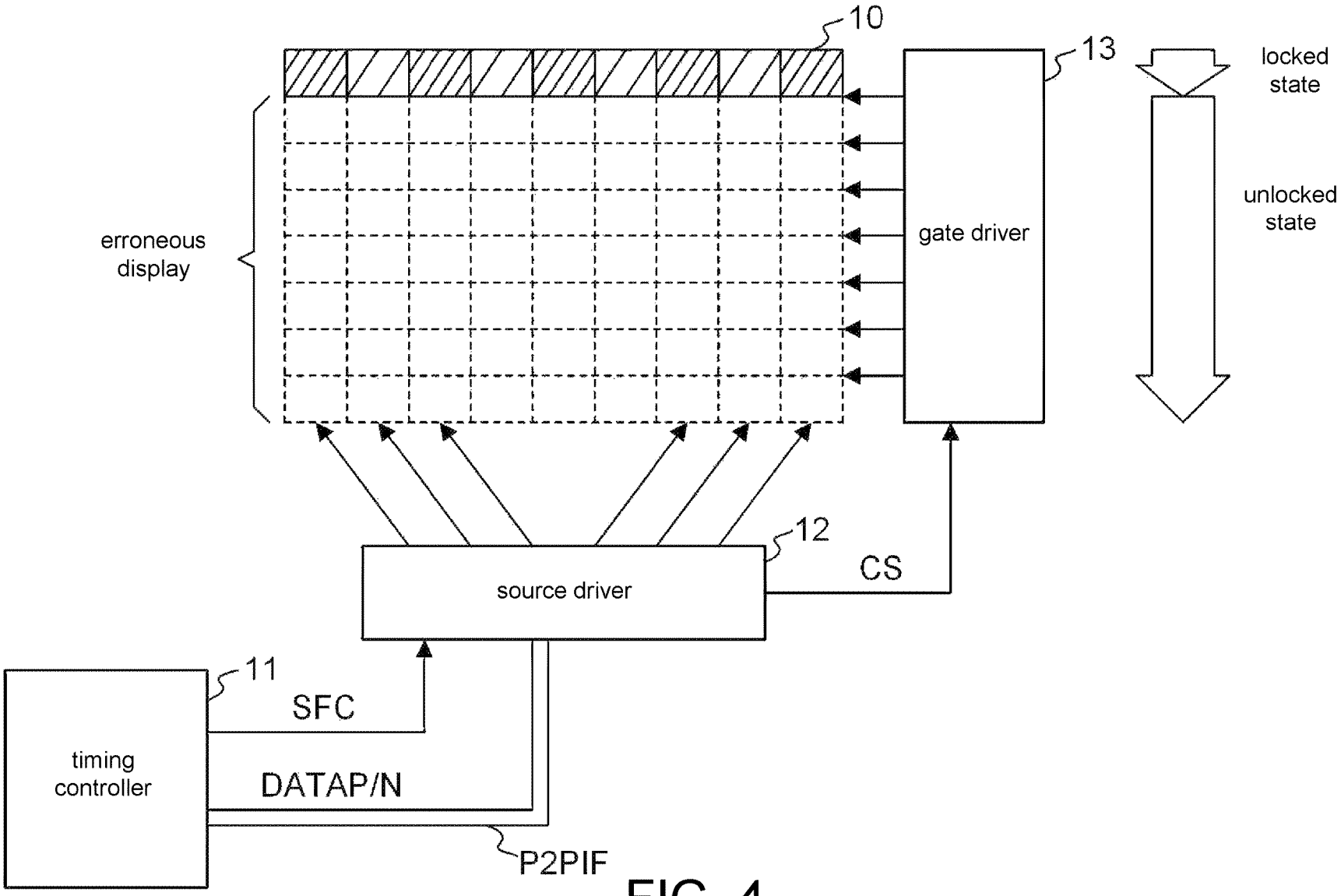
FIG. 4 is a diagram schematically showing a display mode on a display panel of Comparison example 1.

FIG. 4 is a diagram schematically showing a display mode of the display panel in the display device of Comparison example 1. If the unlocked state of the P2PIF occurs in the display period L2DP, normal gate pulse application and pixel drive voltage application are not performed, and thus image display after the second line (the horizontal scanning line S2) is display different from the expected display content (that is, erroneous display).

Figure 5:
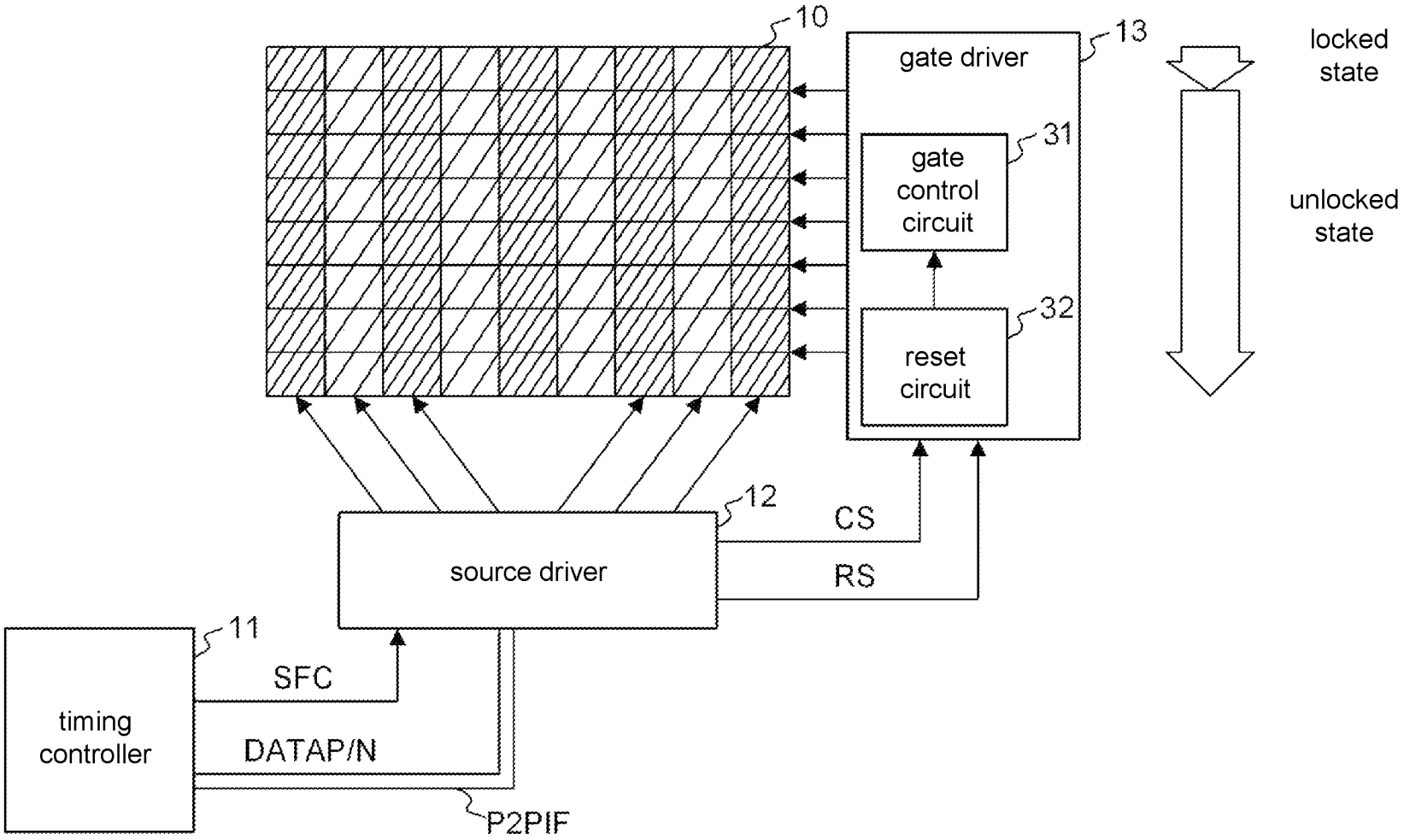
FIG. 5 is a diagram schematically showing a display mode on a display panel of Embodiment 1.

In contrast, FIG. 5 is a diagram schematically showing a display mode of the display panel 10 in the display device 100 of the embodiment. When the unlocked state of the P2PIF occurs in the display period L2DP, the gate pulse application is stopped because of the supply of the gate reset signal RS from the source driver 12 to the gate driver 13, and the previous display state of the display panel 10 is maintained. Thus, unlike the display device of Comparison example 1, no erroneous display occurs on the display panel 10.

As described above, according to the display device of the present embodiment, the erroneous display on the display panel due to the influence of noise or the like can be suppressed.

Embodiment 2

Next, Embodiment 2 of the disclosure is described. A display device of the embodiment is different from the display device of Embodiment 1 in that the source driver includes a plurality of driver ICs.

Figure 6:
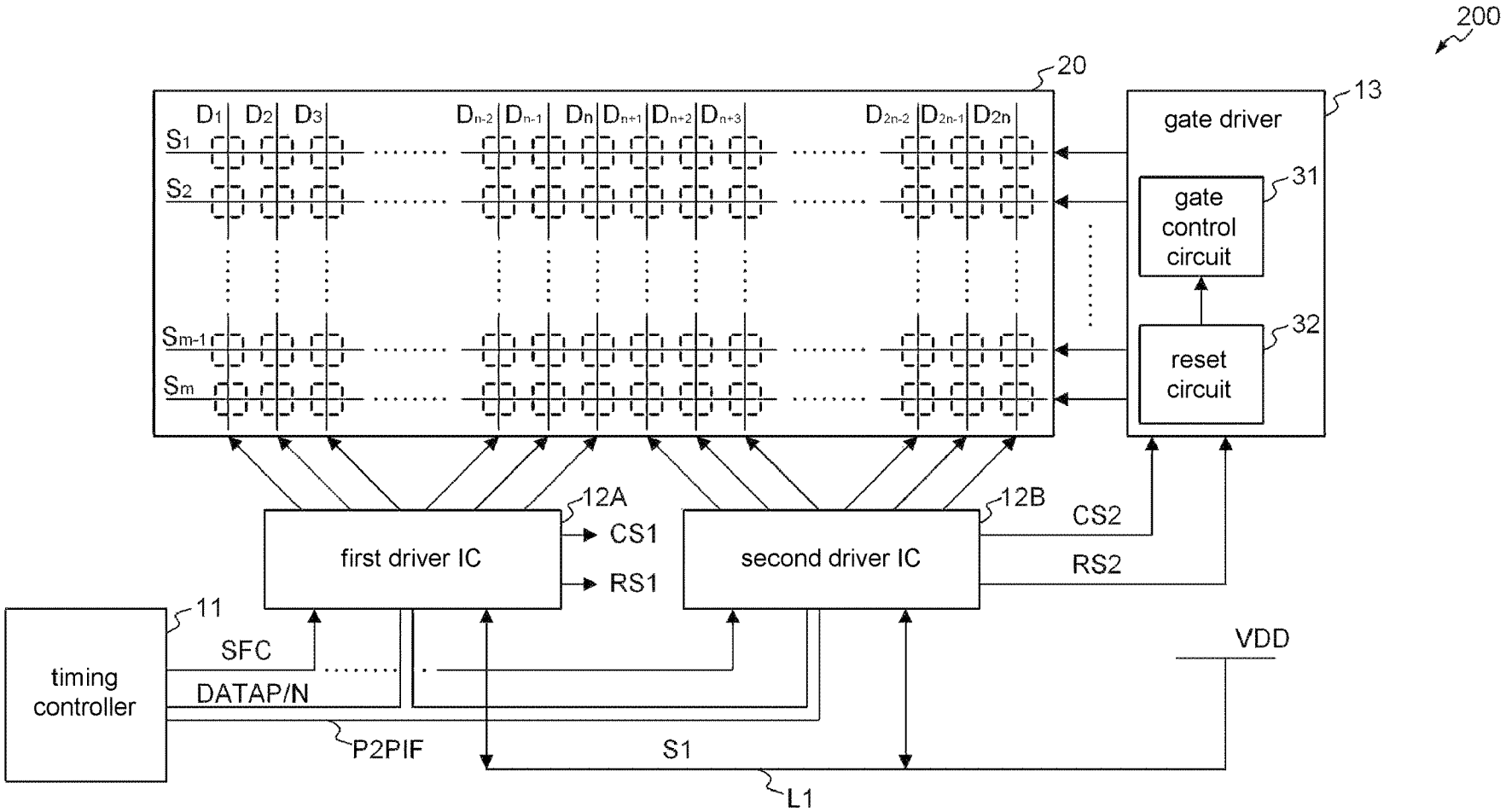
FIG. 6 is a block diagram showing a configuration of a display device according to Embodiment 2.

FIG. 6 is a block diagram showing a configuration of a display device 200 according to the embodiment. The display device 200 includes a display panel 20, a timing controller 11, a first driver IC 12A, a second driver IC 12B, and a gate driver 13.

The display panel 20 is an image display device includes a liquid crystal display panel, an organic EL panel, or the like. In the display panel 20, m horizontal scanning lines S1 to Sm (m is a natural number of 2 or more) extending in a horizontal direction of a two dimensional screen and 2n source lines D1 to D2*n* (n is a natural number of 2 or more) extending in a vertical direction of the two dimensional screen are formed. That is, the display panel 20 of the embodiment has a width approximately twice that of the display panel 10 of Embodiment 1 in the horizontal direction. Display cells serving as pixels are formed in regions at respective intersection portions of the horizontal scanning lines and the source lines.

The timing controller 11 is connected to each of the first driver IC 12A and the second driver IC 12B via a P2PIF, and supplies a data line signal DATAP/N. The timing controller 11 supplies display data or training pattern data to each of the first driver IC 12A and the second driver IC 12B as the data line signal DATAP/N. Similar to Embodiment 1, the P2PIF is switched from an unlocked state to a locked state because of the transmission of the training pattern data in a clock training period. Thus, transmission of display data in the display periods after the clock training period is performed via the P2PIF in the locked state in a normal case (that is, a case when there is no influence of noise or the like).

In addition, the timing controller 11 supplies a data switching signal SFC to each of the first driver IC 12A and the second driver IC 12B. The timing controller 11 supplies the first driver IC 12A and the second driver IC 12B with an "L"-level data switching signal SFC when supplying the training pattern data and with an "H"-level data switching signal SFC when supplying the display data.

The first driver IC 12A is a driver IC which generates n image drive voltages for each horizontal scanning line based on the display data supplied from the timing controller 11 via the P2PIF, and applies the image driver voltages to the source lines D1 to Dn of the display panel 10. Similar to the source driver 12 of Embodiment 1, the first driver IC 12A has a function of generating and outputting a gate control signal CS1 and a gate reset signal RS1. However, since the first driver IC 12A and the gate driver 13 are not connected by a signal line, the gate control signal CS and the gate reset signal RS output from the first driver IC 12A are not supplied to the gate driver 13.

On the other hand, the second driver IC 12B is a driver IC which generates n image drive voltages for each horizontal scanning line based on the display data supplied from the timing controller 11 via the P2PIF, and applies the image drive voltages to the source lines Dn+1 to D2*n* of the display panel 20. Unlike the first driver IC 12A, the second driver IC 12B is connected to the gate driver 13 via a signal line. The second driver IC 12B generates a gate control signal CS2 and supplies the gate control signal CS2 to the gate driver 13. In addition, the second driver IC 12B generates a gate reset signal RS2 and supplies the gate reset signal RS2 to the gate driver 13.

In addition, the first driver IC 12A and the second driver IC 12B are connected by a transmission line L1 for a lock signal S1. The lock signal S1 is a signal which becomes an "L" level when the unlocked state of the P2PIF is detected by either the first driver IC 12A or the second driver IC 12B, and becomes an "H" level otherwise. The transmission line L1 is connected to a power supply which supplies a power supply voltage VDD, and the lock signal S1 has a voltage level of the power supply voltage VDD at the "H" level.

Figure 7:
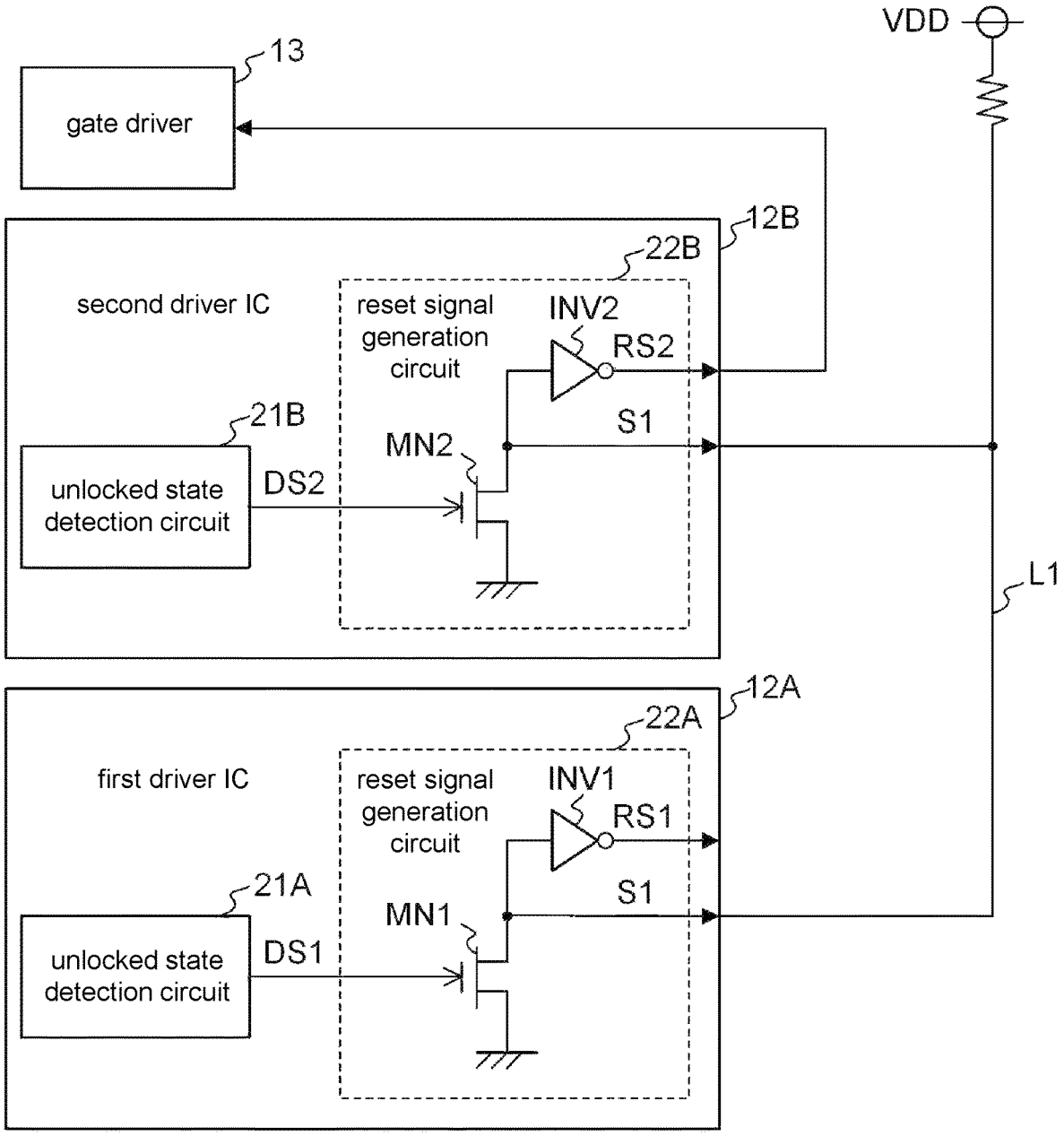
FIG. 7 is a circuit diagram showing configurations of reset signal generation circuits according to Embodiment 2.

FIG. 7 is a circuit diagram showing configurations of reset signal generation circuits of each of the first driver IC 12A and the second driver IC 12B. Here, the gate driver 13 and the unlocked state detection circuit of each driver IC are also shown.

The first driver IC 12A includes an unlocked state detection circuit 21A and a reset signal generation circuit 22A. Based on the data line signal DATAP/N supplied from the timing controller 11, the unlocked state detection circuit 21A detects that the P2PIF between the timing controller 11 and the first driver IC 12A is in the unlocked state. When the unlocked state of P2PIF is detected, the unlocked state detection circuit 21A supplies an "H"-level state detection signal DS1 to the reset signal generation circuit 22A.

The reset signal generation circuit 22A includes a transistor MN1 and an inverter INV1. The transistor MN1 is configured by an N-channel MOS transistor. The source of the transistor MN1 is grounded, and the transistor MN1 receives application of the state detection signal DS1 at the gate. The drain of the transistor MN1 is connected to the transmission line L1 of the lock signal S1 as an open drain terminal.

The inverter INV1 is an inverter circuit which inverts and outputs an input signal. An input end of the inverter INV1 is connected to the drain of the transistor MN1 and is connected to the transmission line L1 of the lock signal S1. Thus, a signal having a logic opposite to that of the lock signal S1 is output as the gate reset signal RS1 from an output end of the inverter INV1. Moreover, since the first driver IC 12A is not directly connected to the gate driver 13 as described above, the reset signal RS1 is not supplied to the gate driver 13.

The second driver IC 12B includes an unlocked state detection circuit 21B and a reset signal generation circuit 22B. Based on the data line signal DATAP/N supplied from the timing controller 11, the unlocked state detection circuit 21B detects that the P2PIF between the timing controller 11 and the second driver IC 12B is in the unlocked state. When the unlocked state of the P2PIF is detected, the unlocked state detection circuit 21B supplies an "H" level state detection signal DS2 to the reset signal generation circuit 22B.

The reset signal generation circuit 22B includes a transistor MN2 and an inverter INV2. The transistor MN2 is configured by an N-channel MOS transistor. The source of the transistor MN2 is grounded, and the transistor MN2 receives application of the state detection signal DS2 at the gate. The drain of the transistor MN2 is connected to the transmission line L1 of the lock signal S1 as an open drain terminal.

The inverter INV2 is an inverter circuit which inverts and outputs an input signal. An input end of the inverter INV2 is connected to the drain of the transistor MN2 and is connected to the transmission line L1 of the lock signal S1. Thus, a signal having a logic opposite to that of the lock signal S1 is output from an output end of the inverter INV2 as the gate reset signal RS2. Unlike the first driver IC 12A, the second driver IC 12B is connected to the gate driver 13 via a signal line, and thus the gate reset signal RS2 is supplied to the gate driver 13.

For example, when the unlocked state of the P2PIF is detected by the unlocked state detection circuit 21A of the first driver IC 12A, the unlocked state detection circuit 21A applies the "H"-level state detection signal DS1 to the gate of the transistor MN1. Accordingly, the transistor MN1 is turned on, and the signal level of the lock signal S1 becomes "L" level (that is, a ground potential VSS level). The "L"-level lock signal S1 output from the reset signal generation circuit 22A is input to the inverter INV2 of the reset signal generation circuit 22B via the transmission line L1. The inverter INV2 outputs an "H"-level reset signal RS2 obtained by inverting the "L"-level lock signal S1, and supplies the reset signal RS2 to the gate driver 13.

On the other hand, when the unlocked state of the P2PIF is detected by the unlocked state detection circuit 21B of the second driver IC 12B, the unlocked state detection circuit 21B applies the "H"-level state detection signal DS2 to the gate of the transistor MN2. Accordingly, the transistor MN2 is turned on, and the signal level of the lock signal S1 becomes the "L" level (that is, the ground potential VSS level). The inverter INV2 outputs the "H"-level reset signal RS2 obtained by inverting the "L"-level lock signal S1, and supplies the reset signal RS2 to the gate driver 13.

If neither driver IC detects the unlocked state of P2PIF, neither of the transistors MN1 and MN2 is turned on, and the signal level of the lock signal S1 is maintained at the "H" level (that is, a power supply potential VDD level).

As described above, in the display device 200 according to the embodiment, when the unlocked state of the P2PIF is detected by either the first driver IC 12A or the second driver IC 12B, the "H"-level gate reset signal RS is supplied to the gate driver 13. In addition, when neither the first driver IC 12A nor the second driver IC 12B detects the unlocked state of the P2PIF, the "L"-level gate reset signal RS is supplied to the gate driver 13.

Referring to FIG. 6 again, the gate driver 13 includes a gate control circuit 31 and a reset circuit 32. The gate control circuit 31 generates gate pulses based on the gate control signal CS2 supplied from the second driver IC 12B, and sequentially and alternatively applies the gate pulses to each of the scanning lines S1 to Sm of the display panel 20. The reset circuit 32 stops the application operation of the gate pulses performed by the gate control circuit 31 according to the gate reset signal RS2 supplied from the second driver IC 12B, and resets the operation state of the gate control circuit 31.

Figure 8:
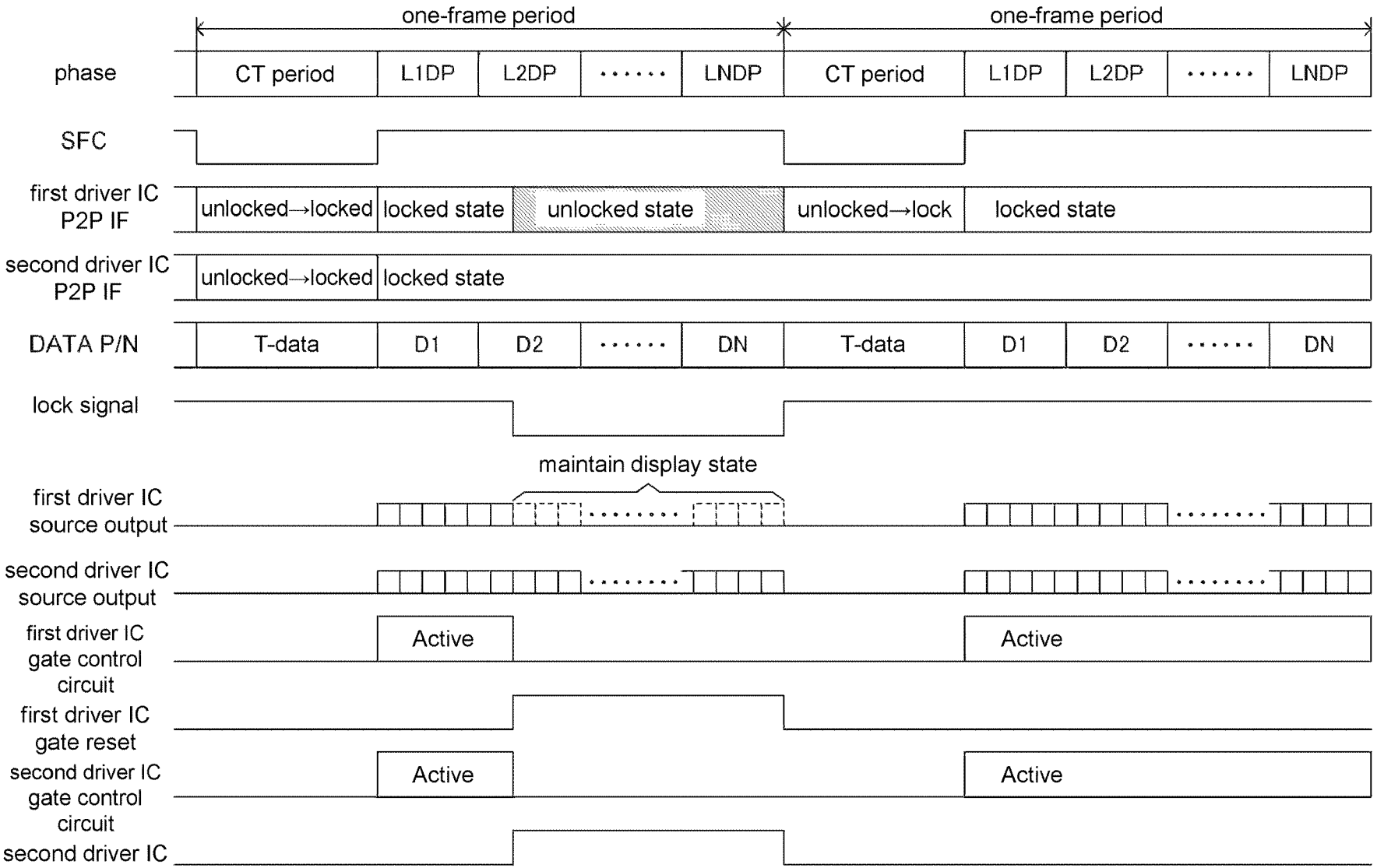
FIG. 8 is a time chart showing states and output signals of respective portions of the display device according to Embodiment 2.

Next, the operation of the display device 200 of the embodiment is described with reference to a time chart in FIG. 8. Moreover, here, the operation when the unlocked state occurs in the P2PIF between the timing controller 11 and the first driver IC 12A during the display periods is described.

First, in the clock training period (shown as a CT period in FIG. 8), the timing controller 11 supplies the "L"-level data switching signal SFC to the first driver IC 12A and the second driver IC 12B. In addition, in this period, the timing controller 11 supplies the training pattern data (shown as T-data in FIG. 8) to the first driver IC 12A and the second driver IC 12B. The P2PIF which is the interface between the timing controller 11 and the first driver IC 12A is switched from the unlocked state to the locked state. Similarly, the P2PIF which is the interface between the timing controller 11 and the second driver IC 12B is switched from the unlocked state to the locked state.

Next, in the display periods (indicated as L1DP, L2DP . . . LNDP in FIG. 8) in which the normal data display is performed, the timing controller 11 supplies the "H"-level data switching signal SFC to the first driver IC 12A and the second driver IC 12B. Then, the timing controller 11 supplies the display data to the first driver IC 12A and the second driver IC 12B as the data line signal DATAP/N. For example, the timing controller 11 first supplies, in the display period L1DP, display data D1 for displaying an image on display cells of the first line (that is, display cells along the horizontal scanning line S1) to the first driver IC 12A and the second driver IC 12B.

The second driver IC 12B supplies the gate control signal CS2 to the gate driver 13. Accordingly, the gate control circuit 31 of the gate driver 13 becomes active, and applies the gate pulse to the first horizontal scanning line S1. In addition, the first driver IC 12A applies n image drive voltages for one horizontal scanning line to the source lines D1 to Dn of the display panel 20. Similarly, the second driver IC 12B applies n image drive voltages for one horizontal scanning line to the source lines Dn+1 to D2*n* of the display panel 20. Thereby, display for one line on the display panel 20 is performed.

Next, in the display period L2DP, the timing controller 11 supplies display data D2 for displaying an image on display cells of the second line (that is, display cells along the horizontal scanning line S2) as the data line signal DATAP/N to the first driver IC 12A and the second driver IC 12B. At this time, if the P2PIF which is the interface between the timing controller 11 and the first driver IC 12A comes into the unlocked state due to the influence of noise of ESD or the like, an abnormality occurs in the transmission of the data line signal DATAP/N between the timing controller 11 and the first driver IC 12A.

The unlocked state detection circuit 21A of the first driver IC 12A detects the unlocked state of the P2PIF between the timing controller 11 and the first driver IC 12A based on the data line signal DATAP/N supplied from the timing controller 11 and applies the "H"-level state detection signal DS1 to the gate of the transistor MN1. Accordingly, the transistor MN1 is turned on, and the signal level of the lock signal S1 becomes "L" level.

The inverter INV2 of the reset signal generation circuit 22B of the second driver IC 12B receives an input of the "L"-level lock signal S1 at the input end, and outputs the "H"-level gate reset signal RS2 obtained by inverting the "L"-level lock signal S1. The gate reset signal RS2 is supplied to the gate driver 13.

The reset circuit 32 of the gate driver 13 stops the operation of the gate control circuit 31 according to the supply of the "H"-level gate reset signal RS2, and resets the operation state. Accordingly, the application of the gate pulses by the gate control circuit 31 is stopped, and the display panel 20 maintains the previous display state.

In the next frame period, the second driver IC 12B returns the signal level of the gate reset signal RS2 to the "L" level. Since the start of the one-frame period is the clock training period, the timing controller 11 supplies the "L"-level data switching signal SFC and the training pattern data to the first driver IC 12A and the second driver IC 12B. The P2PIF between the timing controller 11 and the first driver IC 12A is switched from the unlocked state to the locked state. The P2PIF between the timing controller 11 and the second driver IC 12B is still maintained at the locked state.

In the subsequent display period, the timing controller 11 sequentially supplies display data D1, D2 . . . DN to the first driver IC 12A and the second driver IC 12B as the data line signal DATAP/N. The second driver IC 12B supplies the gate control signal CS to the gate driver 13. The gate control circuit 31 of the gate driver 13 becomes active, and applies the gate pulses to each of the horizontal scanning lines S1 to Sm. The first driver IC 12A applies the image drive voltages to the source lines D1 to Dn of the display panel 20. The second driver IC 12B applies the image drive voltages to the source lines Dn+1 to D2*n* of the display panel 20. When the unlocked state caused by ESD noise or the like does not occur in the P2PIF, normal image display is performed from the start line in order in the display panel 20.

As described above, in the display device 200 of the embodiment, when the first driver IC 12A detects that the P2PIF between the timing controller 11 and the first driver IC 12A comes into the unlocked state during the display periods, the "L"-level lock signal S1 is supplied to the second driver IC 12B. The second driver IC 12B supplies the gate driver 13 with the "H"-level gate reset signal RS obtained by inverting the "L"-level lock signal S1, and stops the operation of the gate control circuit 31. Accordingly, the display panel 20 maintains the previous display state.

According to the display device 200 of the embodiment, even when the unlocked state of the P2PIF occurs in the P2PIF between a first driver IC 12A which is not directly connected to the gate driver 13 and the timing controller 11, erroneous display of the display panel 20 can be suppressed. This will be described with reference to FIG. 9-FIG. 11.

Figure 9:
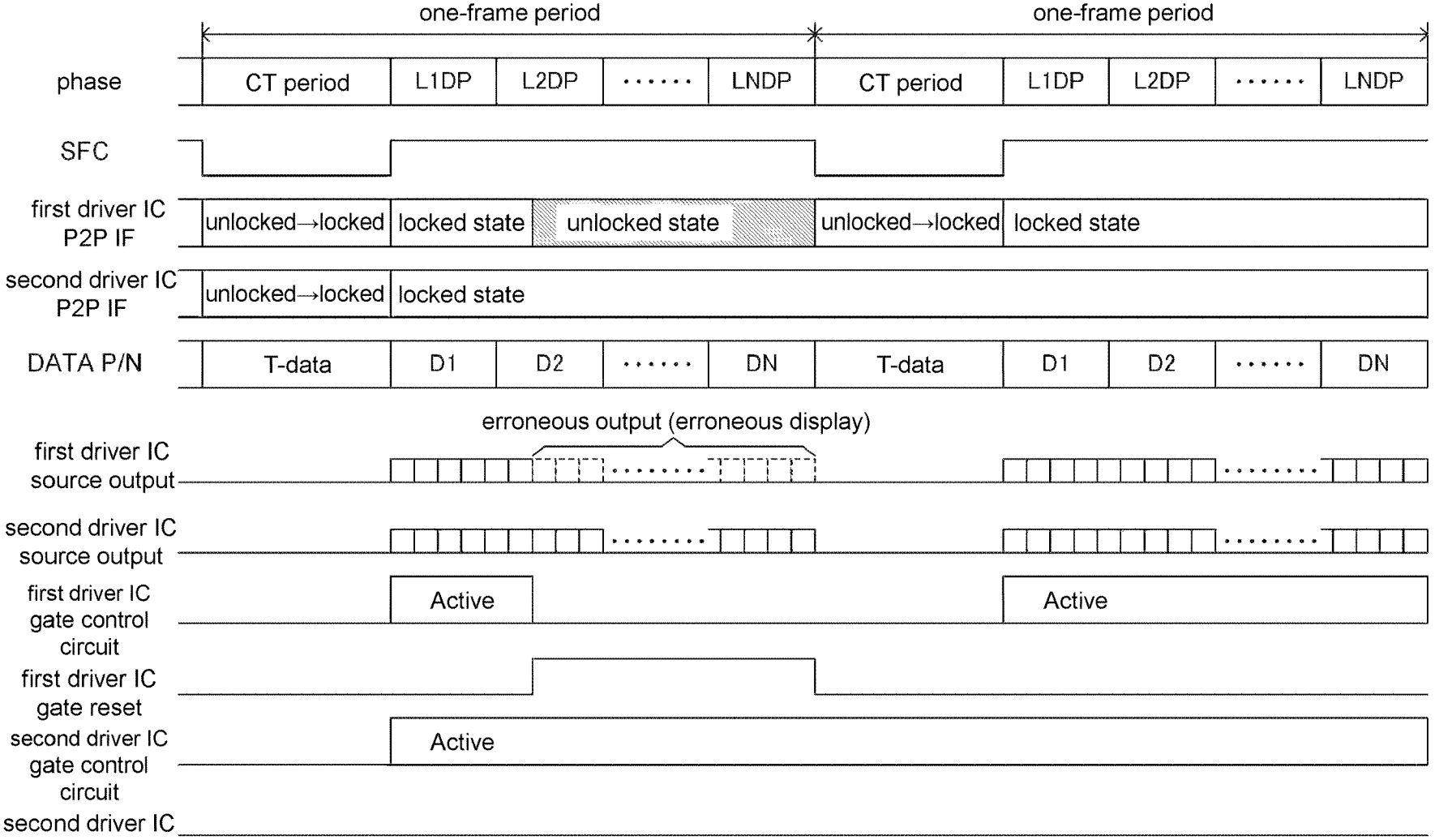
FIG. 9 is a time chart showing states and output signals of respective portions of a display device according to Comparison example 2.

FIG. 9 is a time chart showing the operation of a display device of Comparison example 2 in which, unlike the embodiment, the first driver IC 12A and the second driver IC 12B do not have a signal terminal for the lock signal S1 (that is, the lock signal S1 is not transmitted via the transmission line L1). Operations in the clock training period and the display period L1DP are the same as that of the display device 200 of the embodiment.

In the display period L2DP, if noise caused by ESD occurs and the P2PIF between the timing controller 11 and the first driver IC 12A comes into the unlocked state, the display data output from the timing controller 11 is not normally taken into the first driver IC 12A. Thus, the first driver 12A cannot output the pixel drive voltage (that is, source output) with a normal value.

In addition, since the first driver IC 12A and the gate driver 13 are not connected by a signal line, the gate reset signal RS output from the first driver IC 12A is not supplied to the gate driver 13. Therefore, the gate control circuit 31 continues the application operation of gate pulses as normal.

Figure 10:
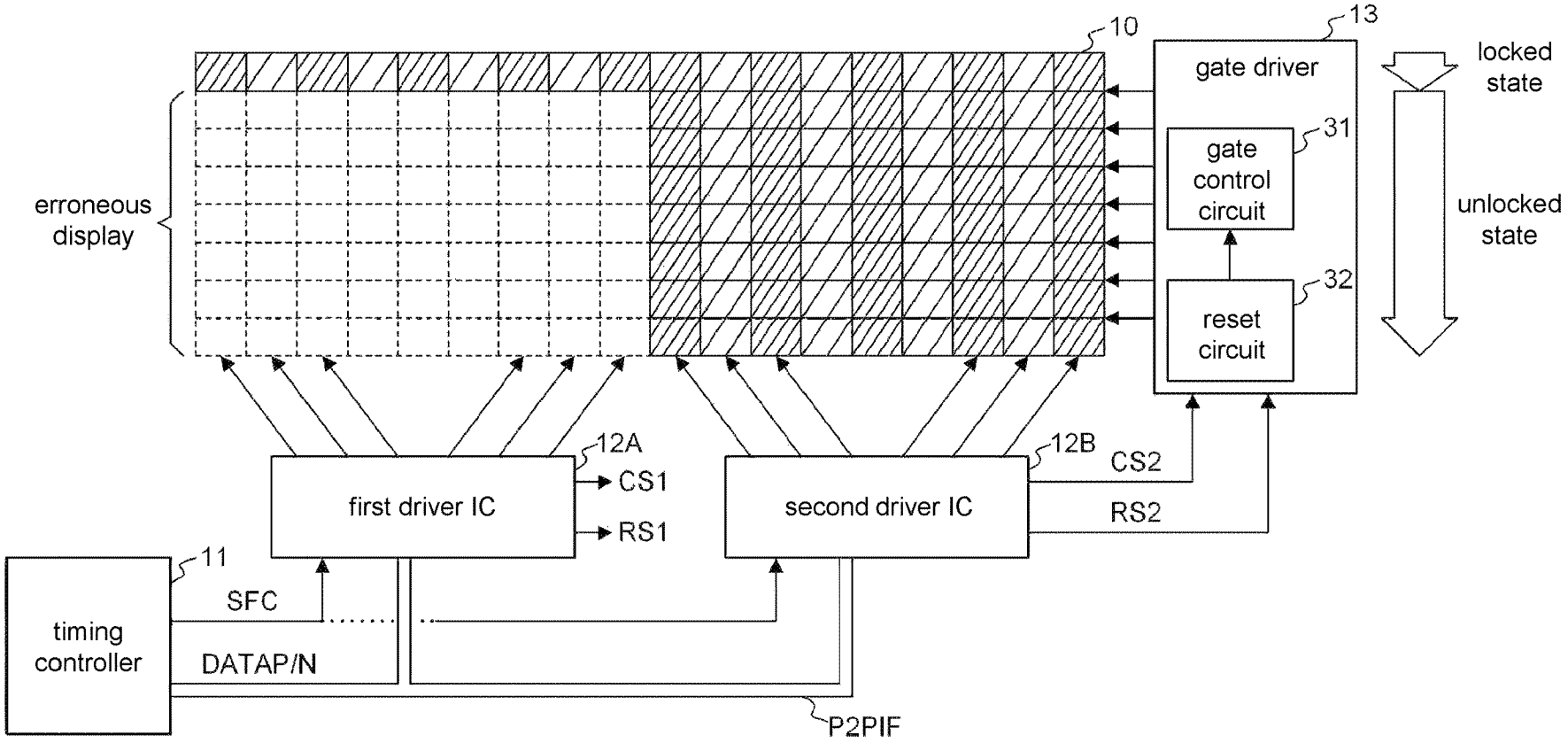
FIG. 10 is a diagram schematically showing a display mode on a display panel of Comparison example 2.

FIG. 10 is a diagram schematically showing a display mode of a display panel in the display device of Comparison example 2. If the unlocked state of the P2PIF between the timing controller 11 and the first driver IC 12A occurs in the display period L2DP, normal pixel drive voltage is not applied to the source lines D1 to Dn, and thus image display after the second line (the horizontal scanning line S2) in the left half of the display panel 20 is display different from the expected display content (that is, erroneous display).

Figure 11:
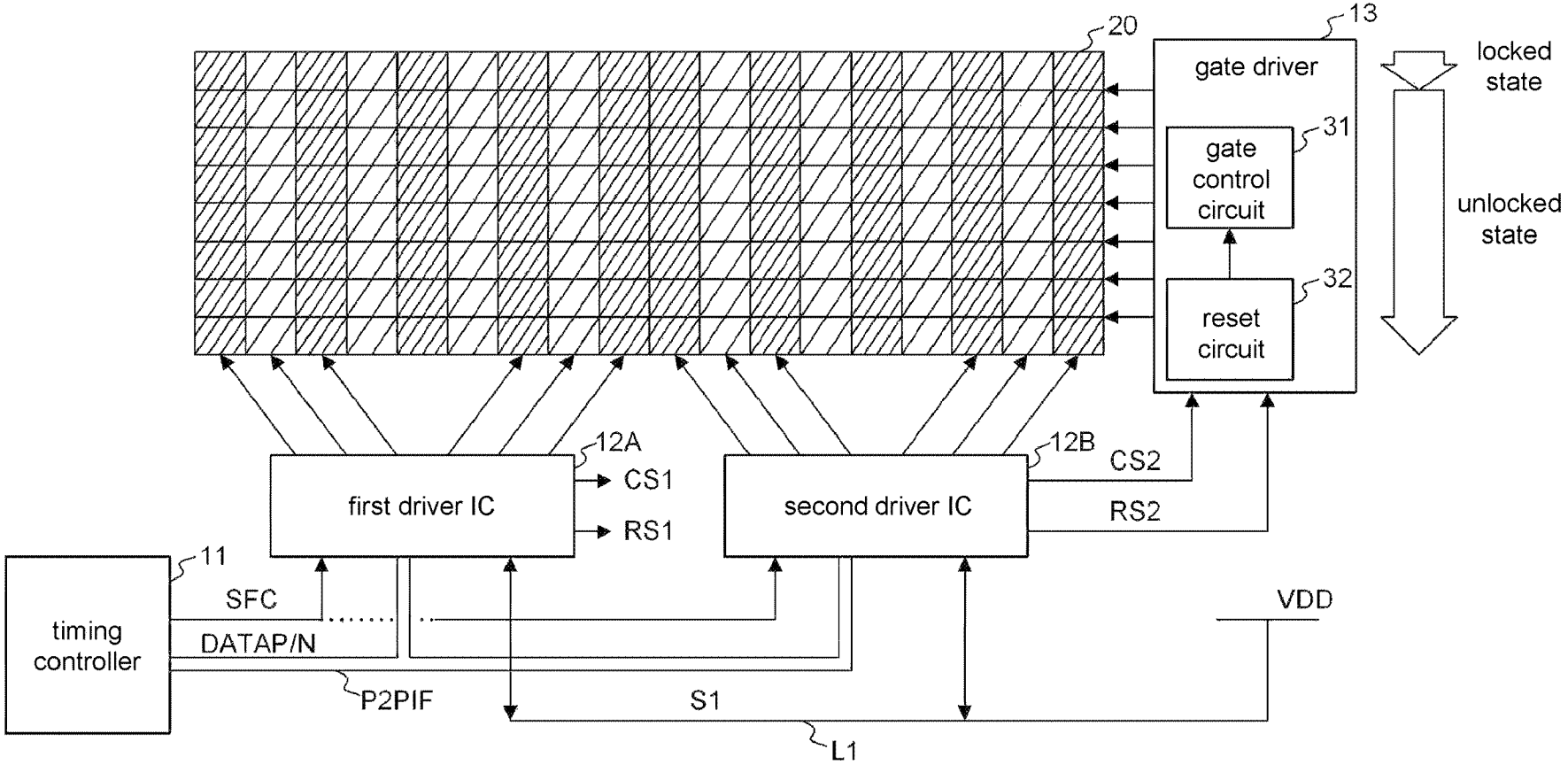
FIG. 11 is a diagram schematically showing a display mode on a display panel of Embodiment 2.

In contrast, FIG. 11 is a diagram schematically showing a display mode of the display panel 20 in the display device 200 of the embodiment. When the unlocked state of the P2PIF between the timing controller 11 and the first driver IC 12A occurs in the display period L2DP, the signal level of the lock signal S1 becomes the "L" level, and the reset signal generation circuit 22B of the second driver IC 12B supplies the gate driver 13 with the "H"-level gate reset signal RS2. Accordingly, the application of the gate pulses is stopped, and the previous display state of the display panel 20 is maintained. Thus, unlike the display device of Comparison example 2, no erroneous display occurs on the display panel 20.

As described above, according to the display device of this embodiment, when the source driver includes a plurality of driver ICs, the erroneous display on the display panel caused by the influence of noise or the like can be suppressed.

Moreover, the disclosure is not limited to the above embodiments. For example, in the above Embodiment 2, the case in which the source driver is configured by two driver ICs is described as an example. However, the number of the driver ICs is not limited hereto, and the disclosure is also applicable to a case in which the source driver includes a plurality of driver ICs of three or more.

In addition, the detection method when the unlocked state detection circuit 21 (21A, 21B) detects the unlocked state of the P2PIF is not particularly limited. For example, the timing controller 11 may supply data including an error code to the source driver 12 as the data line signal DATAP/N, and the source driver 12 may detect the error, thereby detecting the unlocked state of the P2PIF. In addition, the unlocked state of the P2PIF may be detected based on a waveform of the data line signal DATAP/N.

What is claimed is:

1. A display device, comprising:

a display panel which has a plurality of data lines and a plurality of scanning lines, and pixel switches and pixel portions arranged at respective intersection portions of the plurality of data lines and the plurality of scanning lines;

a gate driver which supplies a gate signal of turning on the pixel switches to the plurality of scanning lines;

a display controller which outputs a serial data signal in which a preamble and video data displayed on the display panel are alternately continuous; and a source driver which is connected to the display controller via an interface, detects a locked state or an unlocked state of the interface based on the serial data signal transmitted from the display controller via the interface, and outputs, when the unlocked state of the interface is detected at the time of the supply of the video data, a gate reset signal for stopping the supply of the gate signal from the gate driver, wherein the preamble of the serial data signal comprises a data pattern for clock training, the interface is switched from the unlocked state to the locked state due to transmission of the data pattern for clock training, and the source driver detects that the interface comes into the unlocked state during transmission of the video data started in the locked state of the interface after the transmission of the data pattern for clock training.

2. The display device according to claim 1, wherein the source driver has a detection portion which detects the locked state or the unlocked state of the interface based on the serial data signal, and a gate reset signal output portion which is connected to the detection portion and supplies the gate reset signal to the gate driver.

3. The display device according to claim 1, wherein the serial data signal is a signal in which the preamble and the video data for one frame of the display panel are alternately continuous, and the display panel maintains a display state in a previous frame according to the stop of the supply of the gate signal from the gate driver based on the gate reset signal.

4. A display driver connected to a display panel and a gate driver, wherein the display panel has a plurality of data lines and a plurality of scanning lines and pixel switches and pixel portions arranged at respective intersection portions of the plurality of data lines and the plurality of scanning lines, the gate driver supplies a gate signal of turning on the pixel switches to the plurality of scanning lines, and the display driver supplies a gradation voltage signal which corresponds to video data to the plurality of data lines;

wherein the display driver is connected to a display controller via an interface and receives supply of a serial data signal in which a preamble and the video data are alternately continuous via the interface from the display controller, and the display driver has:

a detection portion which detects that the interface is in a locked state and an unlocked state based on the serial data signal transmitted via the interface, and a gate reset signal output portion which outputs a gate reset signal for stopping an operation of the gate driver when the unlocked state of the interface is detected by the detection portion at the time of the supply of the video data, wherein the preamble of the serial data signal comprises a data pattern for clock training, the interface is switched from the unlocked state to the locked state due to transmission of the data pattern for clock training, and the detection portion detects that the interface comes into the unlocked state during transmission of the video data started in the locked state of the interface after the transmission of the data pattern for clock training.

* * * * *